United States Patent [19]

Anderson

[11] 4,173,433

[45] Nov. 6, 1979

[54] TWO-STAGE GAS COMPRESSOR

[76] Inventor: John M. Anderson, P.O. Box 5202, Corpus Christi, Tex. 78405

[21] Appl. No.: 875,257

[22] Filed: Feb. 6, 1978

[51] Int. Cl.[2] ..... F04B 3/00; F04B 5/00; F04B 25/00; F04B 21/08

[52] U.S. Cl. ..... 417/254; 417/439

[58] Field of Search ..... 417/267, 439, 268, 258, 417/254; 92/86.5

[56] References Cited

U.S. PATENT DOCUMENTS

| | | | |
|---|---|---|---|
| Re. 13,645 | 11/1913 | Stone | 417/266 |
| 1,661,661 | 3/1928 | Greenwald | 417/439 |
| 2,705,592 | 4/1955 | Reiser | 417/439 |
| 3,809,506 | 5/1974 | Malcosky | 417/439 |

*Primary Examiner*—Richard E. Gluck
*Attorney, Agent, or Firm*—Fulbright & Jaworski

[57] ABSTRACT

A two-stage gas compressor in which a double acting piston reciprocates in a cylinder in a housing and on a stationary member in which unnecessary compression of gas in the piston interior is avoided and in which gas bypassing the piston rings is prevented from leaking out of the compressor. The piston includes a set of piston rings at each end and between the piston and the stationary member and is actuated by a piston rod sealingly extending through the housing. An opening is provided through the wall of the piston between the two sets of piston rings and a passageway in the housing extends between the compressor first-stage inlet and the piston opening whereby any gas bypassing any of the piston rings and accumulating in the piston cavity will pass to the low pressure first-stage inlet and away from the piston rod packing. The piston includes an external reduced portion between the two sets of piston rings which is in communication with the piston opening and is of a sufficient length to remain in communication with the housing passageway during the entire stroke of the piston.

2 Claims, 1 Drawing Figure

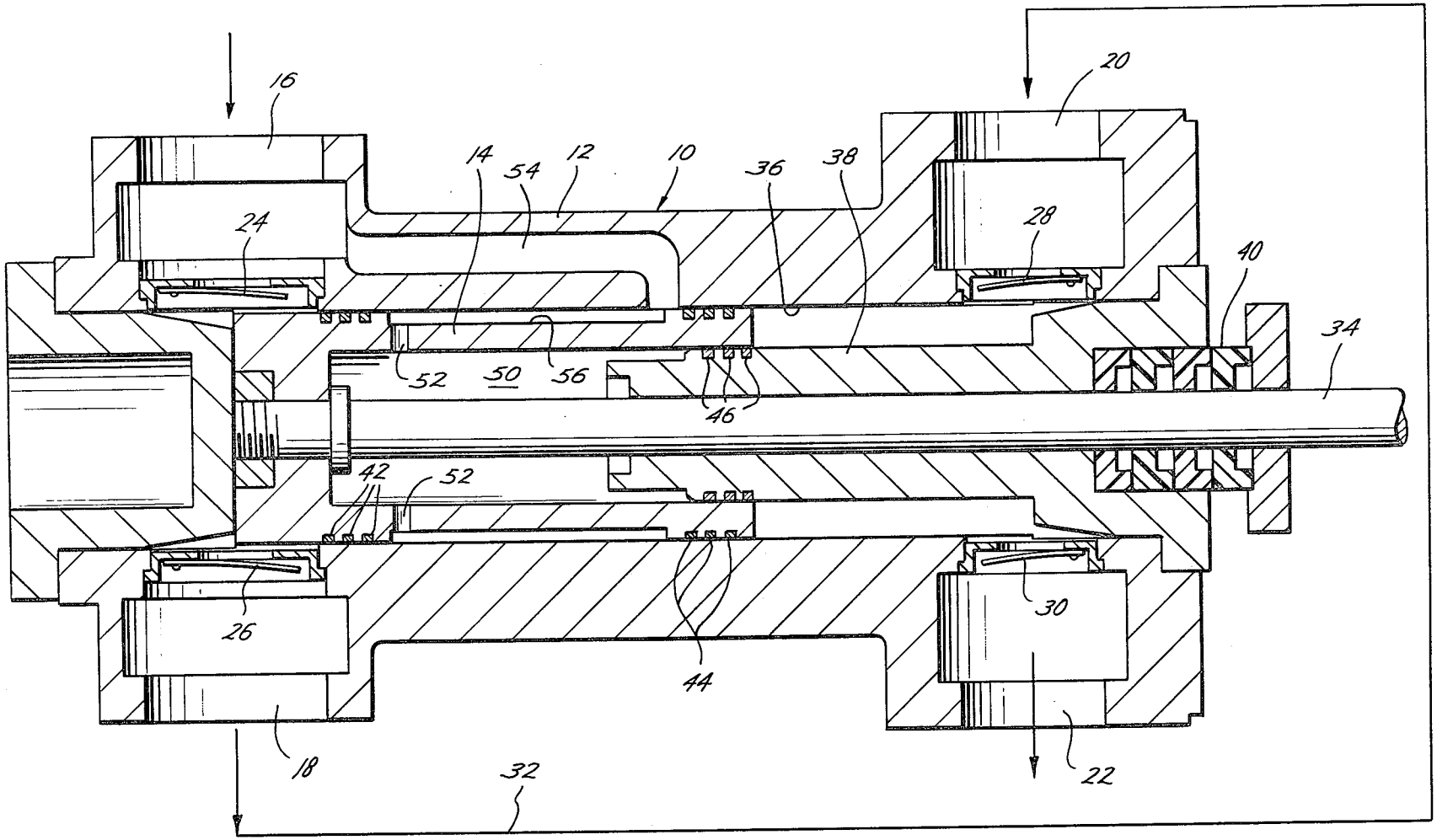
34
40
20
28
38
36
10
12
54
14
16
24
22
30
46
56
50
52
52
42
44
32
26
18

TWO-STAGE GAS COMPRESSOR

BACKGROUND OF THE INVENTION

The use of a two-stage compressor reciprocating in a cylinder and on a stationary member is old as shown in U.S. Pat. No. 13,645 Re. However, the prior art air compressor allows air trapped between the piston and the stationary member to be vented to the atmosphere, which while satisfactory for air, is totally unacceptable for compressing a toxic, explosive, or expensive gas such as natural gas.

The present invention is directed to an improved two-stage gas compressor which avoids leakage of gas from the compressor and avoids unnecessarily compressing gas in the interior of the piston.

SUMMARY

The present invention is directed to an improvement in a two-stage gas compressor having a housing with a double acting piston reciprocable in a cylinder in a housing and about a stationary member by providing a passageway extending from the interior of the double acting piston through the side of the piston to a lower pressure gas enclosure for preventing escape of the gas from the compressor as well as preventing unnecessary compression of the gas in the interior of the piston.

Still a further object of the present invention is the improvement in a two-stage gas compressor having a housing with a first-stage inlet and outlet, and a second-stage inlet and outlet, with a double acting piston having two sets of piston rings reciprocating in a single cylinder in the housing and about a stationary member which has piston rings engaging the interior cavity of the piston. An opening is provided through the piston between the two sets of piston rings and a passageway in the housing extends between the first stage inlet and the opening for venting gas from the piston interior.

A still further object is the provision of an external reduced portion in the piston between the two sets of piston rings. The reduced portion is of a sufficient length to remain in communication with the housing passageway during the entire stroke of the piston and the reduced portion is in communication with the opening through the piston.

Other and further objects, features and advantages will be apparent from the following description of a presently preferred embodiment of the invention, given for the purpose of disclosure and taken in conjunction with the accompanying drawing.

BRIEF DESCRIPTION OF THE DRAWING

The drawing is an elevational view, partly in cross section, of the two-stage gas compressor of the present invention.

DESCRIPTION OF THE PREFERRED EMBODIMENT

Referring now to the drawing, the reference numeral 10 generally indicates the compressor of the present invention having a housing 12 and a double acting piston 14 which reciprocates therein.

The housing 12 includes a first-stage gas input 16, a first-stage gas output 18, a second-stage gas input 20 and a second-stage gas output 22. Suitable check valves 24, 26, 28, and 30 are provided at the input 16, the output 18, the input 20 and the output 22, respectively. In use, the first-stage output is connected to the second-stage input 20 by a suitable conduit 32.

A piston rod 34 is longitudinally reciprocated and actuated by a suitable engine (not shown) and in turn reciprocates the double acting piston 14 within a cylinder 36 in the housing 12. The piston 14 also reciprocates back and forth over a stationary member 38 extending into the piston interior or cavity 50. Suitable gland packing 40 is provided about the piston rod 34 to prevent gas leakage to the atmosphere from the housing 12.

The piston 14 includes a first set of piston rings 42 about one end and a second set of piston rings 44 about the second end. And piston rings are provided between the piston 14 and the stationary member 38, such as piston rings 46 on the stationary member 38.

Referring to the first-stage end of the compressor 10, as the piston 14 moves to the right low pressure gas is drawn through the first-stage input 16 through the check valve 24 and as the piston 14 reciprocates to the left the gas in the first stage is compressed and expelled through check valve 26 through the first-stage output 18. Meanwhile, at the second-stage end of the compressor 10, as the piston 14 moves to the left the gas expelled from the first-stage output 18 is drawn through the second-stage input 20 through the check valve 28 and into the cylinder 36. The gas in the second-stage portion of the cylinder 36 is then expelled, as the piston 14 moves to the right, through the check valve 30 and second stage output 22.

However, as the piston 14 reciprocates on the stationary member 38, any gas in the piston cavity 50 will alternately be compressed and expanded thereby wasting energy by unnecessarily compressing the gas in the cavity 50. Furthermore, even though the packing 40 may be quite secure, the gas in the cavity 50 is highly compressed upon reciprocation of the piston 14 and would increase the tendency of the packing 40 to leak which is highly undesirable in the case of toxic, explosive, or expensive gases. Such leakage is unacceptable and in prior art devices the leakage would continue as all piston rings have some gas bypass and gas would continue to flow into the piston cavity 50 and continue to leak out into the atmosphere.

The present invention is directed to venting the piston cavity 50 for the purpose of preventing unnecessary compression of gas in the cavity 50 as well as insuring that any gas leaking to the cavity 50 will be transmitted to a low pressure enclosure away from the packing 40 and saved. Thus, one or more openings 52 are provided in the sidewall of the piston 40 between the two sets of piston rings 42 and 44 and a passageway 54 is provided in the housing 12 extending from the openings 52 preferably to the first-stage inlet 16 which is at a lower pressure than any other portion of the compressor 10. Preferably, the piston 14 includes an external reduced portion 56 which is in communication between the passageway 54 and the opening 52 and is of a sufficient length to remain in communication with the passageway 54 during the entire stroke of the piston 14. Therefore, as the piston 14 reciprocates on the member 38, and the piston cavity 50 increases and decreases in volume, gas may flow freely into and out of the cavity 50 through the openings 52, piston portion 56 and passageway 54 to and from the compressor input 16 thereby avoiding unnecessary high compression of the gas in the piston cavity 50. Furthermore, any gas leakage passing any of the piston rings 42, 44 and 46 will be in a direction of lower pressure towards either the piston cavity 50 or reduced piston portion 56 and the passageway 54. The piston cavity 50 will remain at a low pressure during operation of the compressor 10 thus allowing the packing gland 40 to securely seal against the piston rod 34 and prevent the escape of gas to the atmosphere.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. In a two-stage gas compressor having a housing with a first-stage inlet and outlet and a second-stage inlet and outlet, a double acting piston having two sets of piston rings reciprocal in a cylinder in the housing and reciprocal about a stationary member having piston rings engaging an interior cavity of the piston and a piston rod sealingly extending through the housing, the improvement comprising, an opening through the piston between the two sets of piston rings, and a passageway in the housing extending between the first stage inlet and the cylinder at a position at all times between the two sets of piston rings thereby remaining in communication with the opening whereby gas bypassing any of the piston rings will pass to the first-stage inlet and unnecessary compression of gas in the piston is avoided.

2. The apparatus of claim 1 including, said piston including an external reduced portion between said two sets of piston rings, said portion being of sufficient length to remain in communication with the passageway in the housing during the entire stroke of said piston, said reduced portion being in communication with the opening through the piston.

* * * * *